US010212499B1

(12) United States Patent
Groomer

(10) Patent No.: US 10,212,499 B1
(45) Date of Patent: Feb. 19, 2019

(54) FETAL COMMUNICATION SYSTEM

(71) Applicant: Cheryl Groomer, Harvey, IL (US)

(72) Inventor: Cheryl Groomer, Harvey, IL (US)

( * ) Notice: Subject to any disclaimer, the term of this patent is extended or adjusted under 35 U.S.C. 154(b) by 0 days.

(21) Appl. No.: 15/889,506

(22) Filed: Feb. 6, 2018

(51) Int. Cl.
*H04R 1/02* (2006.01)
*H04R 1/10* (2006.01)

(52) U.S. Cl.
CPC ..... *H04R 1/025* (2013.01); *H04R 1/1008* (2013.01); *H04R 1/1025* (2013.01); *H04R 1/1041* (2013.01); *H04R 2201/023* (2013.01); *H04R 2201/028* (2013.01); *H04R 2420/07* (2013.01); *H04R 2420/09* (2013.01)

(58) Field of Classification Search
CPC ..... H04R 1/02; H04R 1/025; H04R 1/1041; H04R 1/1008; H04R 1/1025; H04R 2201/023; H04R 2201/028; H04R 2420/07; H04R 2420/09; H04R 3/00; G06F 1/163; G06F 19/00; G06F 3/011; A61B 5/6804
See application file for complete search history.

(56) References Cited

U.S. PATENT DOCUMENTS 4,450,495 A * 5/1984 Naruki ..... G11B 25/063 224/674
4,798,539 A * 1/1989 Henry ..... A61H 23/0236 224/236
5,491,756 A * 2/1996 Francais ..... H04R 5/023 381/332
5,699,558 A * 12/1997 Min ..... H04R 5/023 2/48
5,913,834 A 6/1999 Francais
6,169,814 B1 1/2001 Johnson
6,718,044 B1 4/2004 Alleyne
6,781,044 B2 * 8/2004 Rodriguez ..... C12N 9/1029 435/193
6,840,775 B2 1/2005 Sailors
6,949,074 B2 9/2005 Fatemi
D529,896 S 10/2006 Anderson
8,121,305 B2 2/2012 Servello
2004/0180318 A1 * 9/2004 Sailors ..... G09B 5/04 434/365
2007/0009117 A1 * 1/2007 Laflamme ..... G09F 3/005 381/124
2011/0144551 A1 * 6/2011 Johnson ..... A61F 5/028 602/19
2016/0193491 A1 * 7/2016 Sato ..... A63B 21/00 482/93
2017/0164089 A1 * 6/2017 Lee ..... H04R 1/1025

FOREIGN PATENT DOCUMENTS

CA 2114076 A 5/1995

* cited by examiner

*Primary Examiner* — Thang V Tran
(74) *Attorney, Agent, or Firm* — Kyle A. Fletcher, Esq.

(57) ABSTRACT

The fetal communication system comprises a belt unit and a headset. The headset comprises a microphone that picks up audible sounds and transmits them to the belt unit. By way of example and not of limitation, the audible sounds may be a pregnant woman speaking to her unborn child, music, or educational programs. The belt unit holds a sound transducer in place over the pregnant woman's abdomen via a belt strap that passed around her midsection. A circuit in the belt unit receives the wireless signal sent by the headset, amplifies the audio portion of the signal, and passes the audio signal to the sound transducer. The audible sounds played by the sound transducer may pass through the abdomen to the fetus.

13 Claims, 3 Drawing Sheets

FETAL COMMUNICATION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of early child development, more specifically, a fetal communication system.

SUMMARY OF INVENTION

The fetal communication system comprises a belt unit and a headset. The headset comprises a microphone that picks up audible sounds and transmits them to the belt unit. By way of example and not of limitation, the audible sounds may be a pregnant woman speaking to her unborn child, music, or educational programs. The belt unit holds a sound transducer in place over the pregnant woman's abdomen via a belt strap that passed around her midsection. A circuit in the belt unit receives the wireless signal sent by the headset, amplifies the audio portion of the signal, and passes the audio signal to the sound transducer. The audible sounds played by the sound transducer may pass through the abdomen to the fetus.

An object of the invention is to play audible sounds through an abdominal wall to a developing fetus.

Another object of the invention is to provide a headset with a microphone to pick up the audible sounds to be played to the fetus.

A further object of the invention is to wirelessly transmit the audible sounds picked up by the microphone to a belt unit worn by the pregnant woman.

Yet another object of the invention is to receive the wireless signal sent at the belt unit, amplify the audio portion of the signal, and play the audible sounds into the abdomen via a sound transducer positioned against the abdomen.

These together with additional objects, features and advantages of the fetal communication system will be readily apparent to those of ordinary skill in the art upon reading the following detailed description of the presently preferred, but nonetheless illustrative, embodiments when taken in conjunction with the accompanying drawings.

In this respect, before explaining the current embodiments of the fetal communication system in detail, it is to be understood that the fetal communication system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fetal communication system.

It is therefore important that the claims be regarded as including such equivalent construction insofar as they do not depart from the spirit and scope of the fetal communication system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
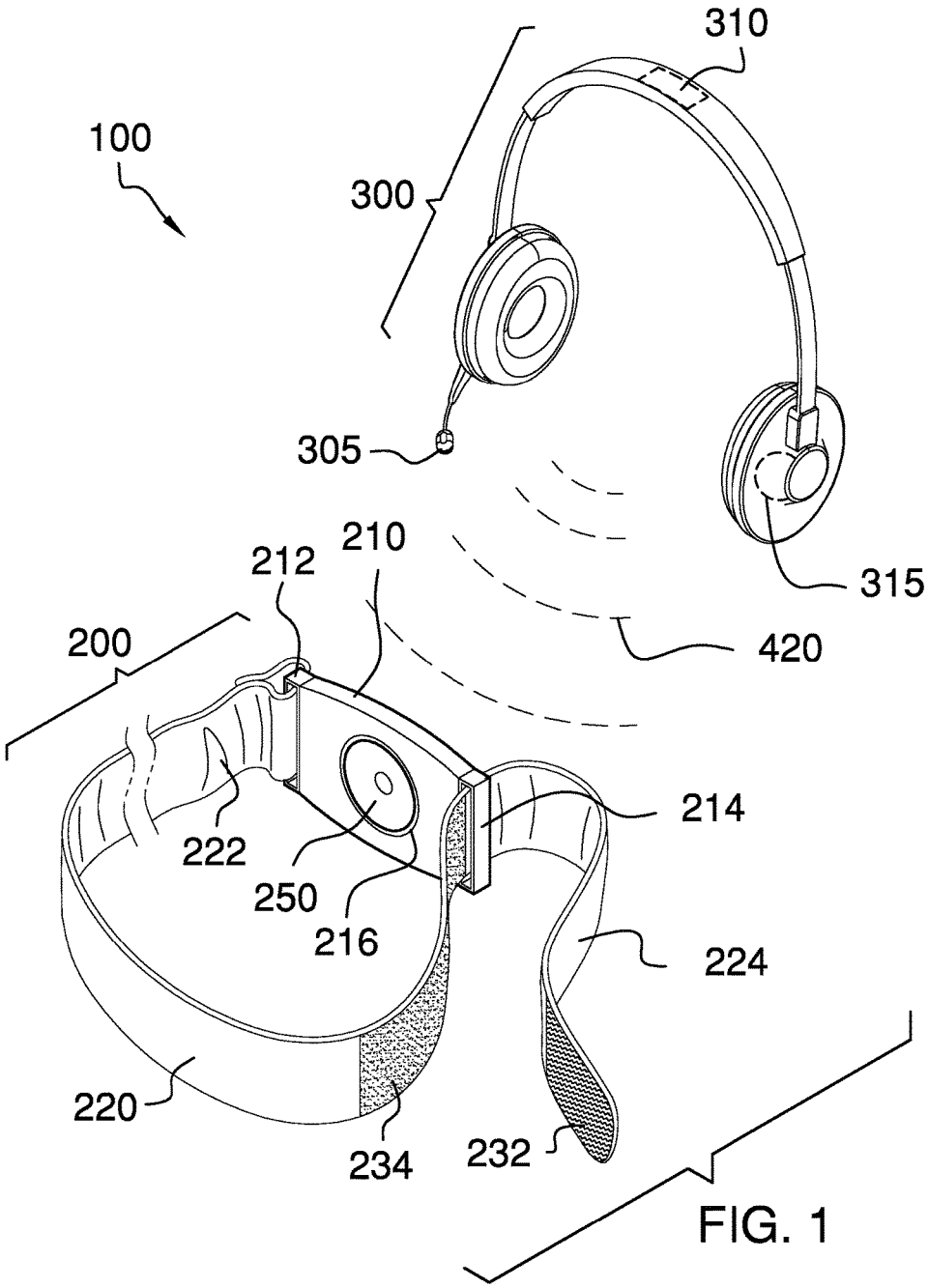
FIG. 1 is a perspective view of an embodiment of the disclosure.
Figure 2:
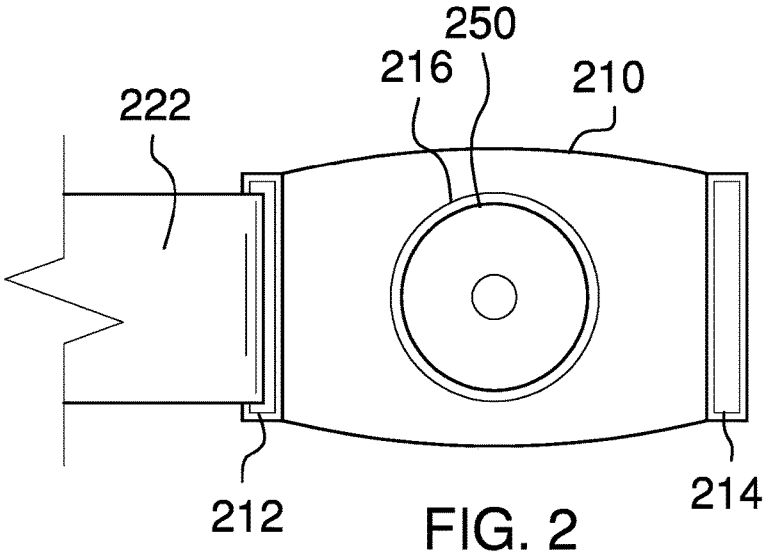
FIG. 2 is a rear view of an embodiment of the disclosure focusing on the belt unit.
Figure 3:
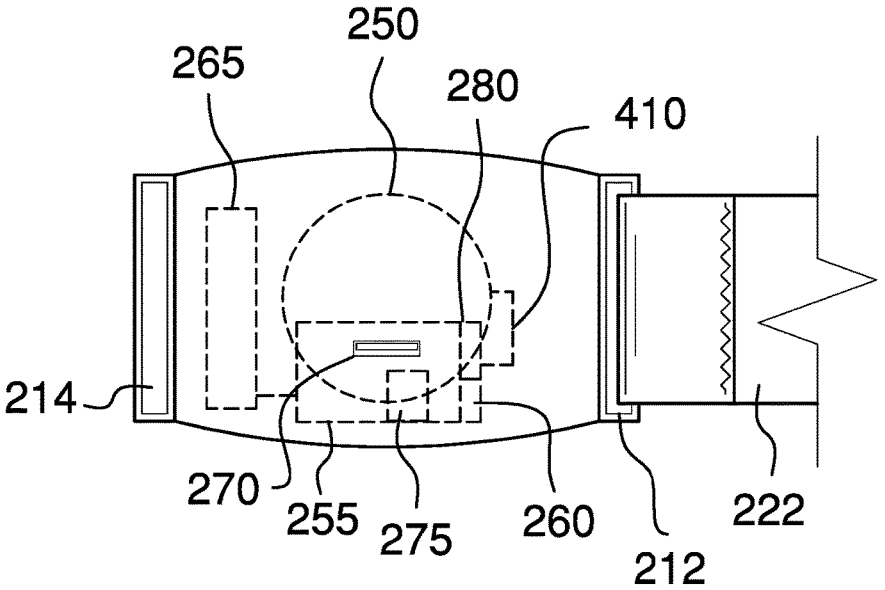
FIG. 3 is a front view of an embodiment of the disclosure focusing on the belt unit.
Figure 4:
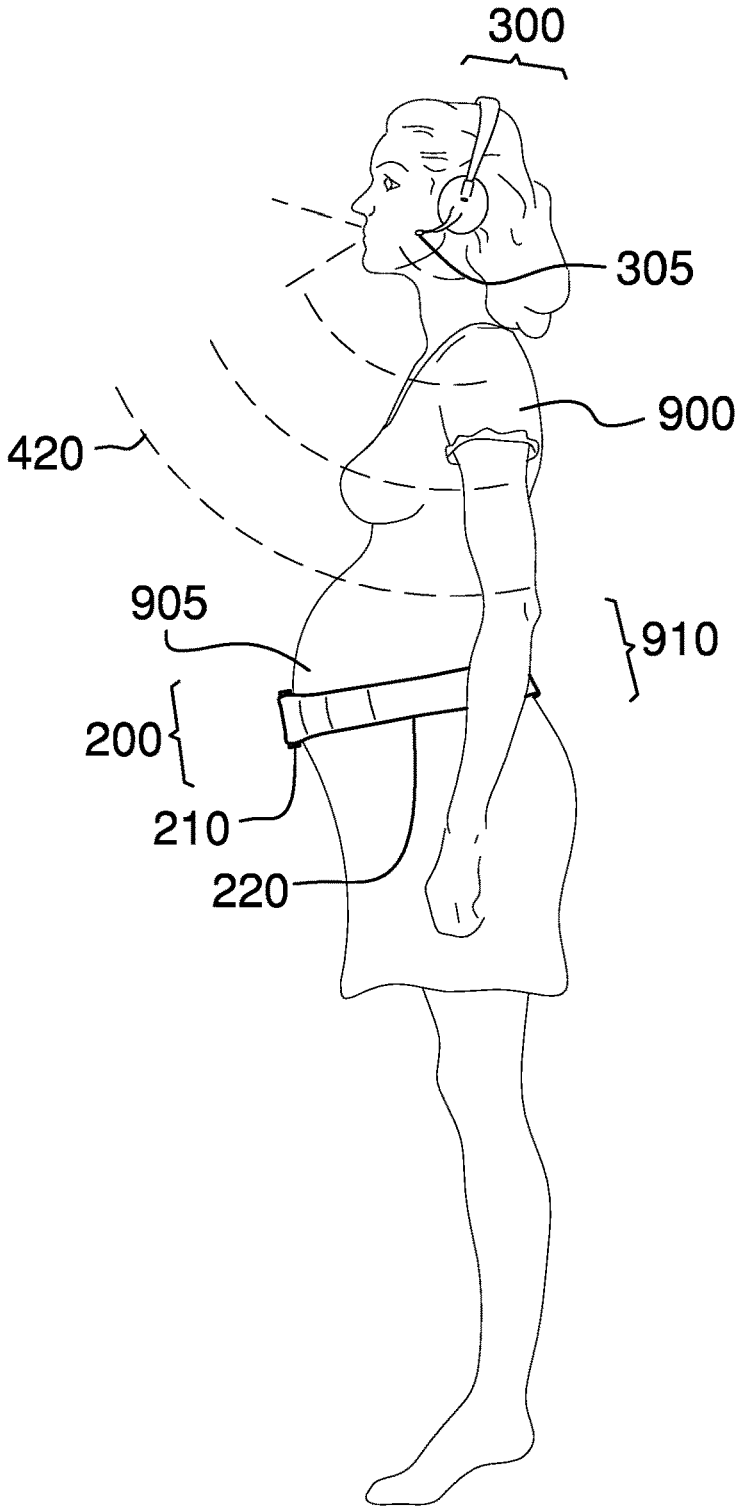
FIG. 4 is an in-use view of an embodiment of the disclosure.

Detailed reference will now be made to a first potential embodiment of the disclosure, which is illustrated in FIGS. 1 through 4.

The fetal communication system 100 (hereinafter invention) comprises a belt unit 200 and a headset 300. The belt unit 200 is adapted to be worn by a pregnant woman 900 such that a sound transducer 250 is held in place over an abdomen 905. Audible sounds played through the sound transducer 250 may pass through the abdomen 905 and may be heard by a fetus (not illustrated in the figures). The audible sounds may be music, the mother's voice, or other audio programming. The audible sounds may originate at a microphone 305 located on the headset 300.

The belt unit 200 comprises a casing 210 and a belt strap 220. The belt strap 220 may be adapted to surround a midsection of the pregnant woman 900 and may be adapted to hold the casing 210 against the abdomen 905 in front of the pregnant woman 900.

The casing 210 may be a housing for the sound transducer 250, a control circuit 255, and a belt battery 265. The casing may be defined by a front side and a rear side. The front side is defined to be the side that faces away from the abdomen 905. The rear side is defined to be the side opposite the front side—the side that faces towards the abdomen 905.

The sound transducer 250 may be a device that receives an electrical signal encoding audio 410 from the control circuit 255 and transforms the electrical signal encoding audio 410 into the audible sounds.

The sound transducer 250 may be mounted on the rear side of the casing 210 such that the audible sounds produced by the sound transducer 250 propagate into the abdomen 905.

In some embodiments, the casing 210 may comprise a diaphragm 216. The diaphragm 216 may be a waterproof or water resistant membrane to protect the sound transducer 250 from sweat, ultrasound gel, rain, or other fluids.

The control circuit 255 may comprise a receiver 260, an amplifier 280, and a microprocessor 275. The receiver 260 may receive a wireless signal 420 sent from the headset 300 or other sources. The receiver 260 may produce as an output an electrical signal that is fed into the amplifier 280.

The amplifier 280 may accept the electrical signal from the receiver 260 as an input, may increase the amplitude of the electrical signal, and may produce as an output the electrical signal encoding audio 410 that is fed to the sound transducer 250.

The microprocessor 275 may control the overall operation of the belt unit 200. As non-limiting examples, the microprocessor 275 may manage the establishment of the wireless signal 420 between the receiver 260 and the headset 300, may monitor and adjust the amplitude of the electrical signal encoding audio 410 produced by the amplifier 280, may monitor the level of the belt battery 265, and may manage the recharging of the belt battery from a connector 270.

In some embodiments, the microprocessor 275 may manage the establishment of the wireless signal 420 between the receiver 260 and another external source of audio. As a non-limiting example, the other external source of audio may be an MP3 player or computer.

The belt battery 265 may comprise one or more energy-storage devices. The belt battery 265 may be a source of electrical energy to operate the sound transducer 250 and the control circuit 255. The belt battery 265 may be replaceable or rechargeable.

In some embodiments, the belt battery 265 may be recharged by transferring energy into the casing 210 via a cable (not illustrated in the figures) that is plugged into the connector 270.

In some embodiments, a source of audio programming may be coupled to the belt unit 200 via the cable and played for the fetus.

The belt strap 220 may be an elasticized fabric band defined by a first end 222 and a second end 224. The first end 222 may be coupled to the casing 210 at a first belt loop 212. As a non-limiting example, the first end 222 of the belt strap 220 may pass through the first belt loop 212, turn 180 degrees to double back on itself, and may be sewn, glued, or otherwise fastened to itself.

The second end 224 may removably couple to a second belt loop 214 via a hook and loop fastener. Specifically, the second end 224 may comprise hooks 232 and loops 234 such that the second end 224 may be passed through the second belt loop 214, turn 180 degrees to double back on itself, and then coupled by pressing the loops 234 and the hooks 232 together. The length of the loops 234 along the belt strap 220 is at least as long as the length of the hooks 232 along the belt strap 220 plus twice the length variance that is desired. As a non-limiting example, if the length of the hooks 232 along the belt straps 220 is 2 inches and 3 inches of adjustment are desired, then the length of the loops 234 along the belt strap 220 is 8 inches. The length of the belt strap 220 is adjustable by repositioning the hooks 232 relative to the loops 234.

The headset 300 may be a communication device that is adapted to be worn on the head of the pregnant woman 900. The headset 300 may be held in place using an armature that crosses the top of the head or by an armature that wraps around one or both ears.

The headset 300 may comprise the microphone 305, a transmitter 310, and a headset battery 315. The microphone 305 may be an electrical devices that converts the audible sounds into an electrical signal.

The transmitter 310 may be an electrical device that accepts the electrical signal encoding audio 410 as an input and transmits it wirelessly to the receiver 260.

The headset battery 315 may comprise one or more energy-storage devices. The headset battery 315 may be a source of electrical energy to operate the transmitter 310 and the microphone 305. The headset battery 315 may be replaceable or rechargeable.

In use, the casing 210 is placed on the abdomen and the belt strap 220 is wrapped around the midsection 910 of the pregnant woman 900 and fastened in place using the hook and loop fastener. The headset 300 is placed on the head of the pregnant woman 900. With both the headset 300 and the control circuit 255 in the casing 210 turned on, the microprocessor 275 on the control circuit 255 establishes communication between the transmitter 310 in the headset 300 and the receiver 260 on the control circuit 255. As the pregnant woman 900 speaks, the sound of her voice is captured by the microphone 305 and transmitted to the belt unit 200 as modulation of the wireless signal 420. At the belt unit 200, the wireless signal 420 is received by the receiver 260, amplified by the amplifier 280, and presented to the sound transducer 250 where it is converted back to the audible sounds. The audible sounds pass through the abdomen 905 and may be heard by the fetus. The microphone 305 may also be brought into proximity of a source of music to transmit and play the music to the fetus.

As used in this disclosure, an "amplifier" refers to an electronic component that increases voltage, current, or power level of an input signal.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts, which may not be illustrated in the figures.

As used in this disclosure, a "cable" is a collection of insulated wires covered by a protective casing that is used for transmitting electricity or telecommunication signals.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used herein, the word "desired" refers to a specific value within a range of supported values. A "desired" value indicates that a range of values is enabled by the invention and that a user of the invention may select a specific value within the supported range of values based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "fastener" is a device that is used to join or affix two objects. Fasteners generally comprise a first element, which is attached to the first object and a second element which is attached to the second object such that the first element and the second element join to affix the first object and the second object. Common fasteners include, but are not limited to, hooks, zippers, snaps, buttons, buckles, quick release buckles, or hook and loop fasteners.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, a "housing" is a rigid casing that encloses and protects one or more devices.

As used in this disclosure, a "microphone" is a transducer that converts the energy from vibration into electrical energy. The sources of vibrations include, but are not limited to, acoustic energy.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure a "strap" is a strip of leather, cloth, plastic, thin metal, or other flexible material, often with a buckle, that is used to fasten, secure, carry, or hold onto something.

As used in this disclosure, a "transducer" is a device that converts a physical quantity, such as pressure or brightness into an electrical signal or a device that converts an electrical signal into a physical quantity.

As used herein, the words "waterproof" or "watertight" refer to an object that is not harmed when being exposed to water, including total submersion for a period of time. When used as a verb, "waterproof" refers to taking steps to make an object waterproof. Non-limiting examples of such steps may include applying special coatings or using gaskets to seal seams and entry points of an enclosure.

As used herein, "water resistant" refers to an object that is not harmed by incidental exposure to water but may be harmed if totally submerged. As non-limiting examples, incidental exposure to water may include exposure to raindrops, dew, and splashes from puddles.

As used in this disclosure, "wireless" is an adjective that is used to describe a communication channel that does not require the use of physical cabling.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A fetal communication system comprising:

a belt unit and a headset;

wherein the belt unit is adapted to be worn by a pregnant woman such that a sound transducer is held in place over an abdomen;

wherein audible sounds played through the sound transducer pass through the abdomen;

wherein the audible sounds is music, the mother's voice, or other audio programming;

wherein the audible sounds originate at a microphone located on the headset;

wherein the belt unit comprises a casing and a belt strap;

wherein the belt strap is adapted to surround a midsection of the pregnant woman and is adapted to hold the casing against the abdomen in front of the pregnant woman;

wherein the casing is a housing which houses the sound transducer, a control circuit, and a belt battery;

wherein the sound transducer is a device that receives an electrical signal encoding audio from the control circuit and transforms the electrical signal encoding audio into the audible sounds;

wherein the sound transducer is mounted on the rear side of the casing such that the audible sounds produced by the sound transducer propagate into the abdomen;

wherein the control circuit comprises a receiver, an amplifier, and a microprocessor;

wherein the receiver receives a wireless signal sent from the headset or other sources;

wherein the receiver produces as an output an electrical signal that is fed into the amplifier;

wherein the amplifier accepts the electrical signal from the receiver as an input, increases the amplitude of the electrical signal, and produces as an output the electrical signal encoding audio that is fed to the sound transducer.

2. The fetal communication system according to claim 1 wherein the casing comprises a diaphragm;

wherein the diaphragm is a waterproof or water resistant membrane to protect the sound transducer from sweat, ultrasound gel, rain, or other fluids.

3. The fetal communication system according to claim 1 wherein the microprocessor controls the overall operation of the belt unit;

wherein the microprocessor manages the establishment of the wireless signal between the receiver and the headset, monitors and adjust the amplitude of the electrical signal encoding audio produced by the amplifier, monitors the level of the belt battery, and manages the recharging of the belt battery from a connector.

4. The fetal communication system according to claim 3 wherein the microprocessor manages the establishment of the wireless signal between the receiver and an MP3 player or computer.

5. The fetal communication system according to claim 3 wherein the belt battery comprises one or more energy-storage devices;

wherein the belt battery is a source of electrical energy to operate the sound transducer and the control circuit;

wherein the belt battery is replaceable or rechargeable.

6. The fetal communication system according to claim 5 wherein the belt battery is recharged by transferring energy into the casing via a cable that is plugged into the connector.

7. The fetal communication system according to claim 6 wherein a source of audio programming is coupled to the belt unit via the cable.

8. The fetal communication system according to claim 6 wherein the belt strap is an elasticized fabric band defined by a first end and a second end;

wherein the first end is coupled to the casing at a first belt loop;

wherein the first end of the belt strap passes through the first belt loop, turns 180 degrees to double back on itself, and is fastened to itself.

9. The fetal communication system according to claim 8 wherein the second end removably couples to a second belt loop via a hook and loop fastener;

wherein the second end comprises hooks and loops such that the second end is passed through the second belt loop, turns 180 degrees to double back on itself, and then couples by pressing the loops and the hooks together;

wherein the length of the loops along the belt strap is at least as long as the length of the hooks along the belt strap plus twice the length variance that is desired;

wherein the length of the belt strap is adjustable by repositioning the hooks relative to the loops.

10. The fetal communication system according to claim 9 wherein the headset is a communication device that is adapted to be worn on the head of the pregnant woman;

wherein the headset is held in place using an armature that crosses the top of the head or by an armature that wraps around one or both ears.

11. The fetal communication system according to claim 10 wherein the headset comprises the microphone, a transmitter, and a headset battery;

wherein the microphone is an electrical devices that converts the audible sounds into an electrical signal.

12. The fetal communication system according to claim 11 wherein the transmitter is an electrical device that accepts the electrical signal encoding audio as an input and transmits it wirelessly to the receiver.

13. The fetal communication system according to claim 12 wherein the headset battery comprises one or more energy-storage devices;

wherein the headset battery is a source of electrical energy to operate the transmitter and the microphone;

wherein the headset battery is replaceable or rechargeable.

* * * * *